US008316995B2

(12) United States Patent
Czepak et al.

(10) Patent No.: US 8,316,995 B2
(45) Date of Patent: Nov. 27, 2012

(54) HYDRAULIC MACHINE WITH OIL DAMS

(75) Inventors: John Czepak, Burnaby (CA); Gerald Dyck, Abbotsford (CA); Mikael Karlsson, Trollhattan (SE); Robert Amnerud, Lidkoping (SE); Per-Ola Vallebrant, Trollhattan (SE)

(73) Assignees: Parker-Hannifin Corporation, Cleveland, OH (US); Kinetics Drive Solutions, Inc., B.C. (CA)

( * ) Notice: Subject to any disclaimer, the term of this patent is extended or adjusted under 35 U.S.C. 154(b) by 363 days.

(21) Appl. No.: 12/644,488

(22) Filed: Dec. 22, 2009

(65) Prior Publication Data

US 2011/0147126 A1 Jun. 23, 2011

(51) Int. Cl.
*F01M 9/00* (2006.01)

(52) U.S. Cl. ..... 184/6.17

(58) Field of Classification Search ..... 184/6.17; 91/506; 92/12.2, 70, 153
See application file for complete search history.

(56) References Cited

U.S. PATENT DOCUMENTS

| | | | | |
|---|---|---|---|---|
| 3,827,337 | A * | 8/1974 | Pruvot | 91/489 |
| 4,244,279 | A | 1/1981 | Stewart et al. | |
| 4,508,011 | A | 4/1985 | Nolden | |
| 4,991,492 | A * | 2/1991 | Bratt et al. | 92/12.2 |
| 5,009,574 | A | 4/1991 | Ikeda et al. | |
| 5,027,668 | A * | 7/1991 | Nakano | 476/8 |
| 5,545,013 | A | 8/1996 | Beck et al. | |
| 6,260,468 | B1 | 7/2001 | Ryken et al. | |
| 6,279,452 | B1 * | 8/2001 | Moya | 91/506 |
| 6,360,647 | B1 * | 3/2002 | Alm et al. | 91/491 |
| 6,474,444 | B1 * | 11/2002 | Mochizuki | 184/6.12 |
| 6,505,541 | B2 * | 1/2003 | Skirde et al. | 92/12.2 |
| 6,983,680 | B2 * | 1/2006 | Gleasman et al. | 91/499 |
| 6,996,980 | B2 | 2/2006 | Fleming et al. | |
| 7,014,429 | B2 | 3/2006 | Gray, Jr. et al. | |
| 7,325,477 | B2 * | 2/2008 | Vallebrant | 92/153 |
| 7,553,085 | B2 | 6/2009 | Gray, Jr. | |
| 2005/0095155 | A1 | 5/2005 | Blight et al. | |
| 2007/0261547 | A1 | 11/2007 | Liebherr et al. | |

FOREIGN PATENT DOCUMENTS

EP 1030057 B1 8/2000

OTHER PUBLICATIONS

Parker Hannifin AB, Moblie Hydraulics, Wheeled Excavator Transmissions, V14 Series Variable Displacement Motor, HY17-8215/UK, Ed. 01-03, Sweden.

* cited by examiner

*Primary Examiner* — Michael Mansen
*Assistant Examiner* — Mark K Buse
(74) *Attorney, Agent, or Firm* — Daniel Whitman; Robert J. Clark

(57) ABSTRACT

A hydraulic machine includes a support structure and a rotating group rotatably mounted relative to the support structure. The rotating group includes a shaft and a cylinder barrel with a plurality of circumferentially spaced cylinder bores. Reciprocal pistons extend from the shaft with each one of the pistons extending into an associated one of the cylinder bores. A joining assembly joins the shaft and the cylinder barrel so that the shaft and the cylinder barrel rotate together. The hydraulic machine further includes at least one oil dam associated with the rotating group and adapted to trap hydraulic fluid used for lubricating portions of the joining assembly.

15 Claims, 8 Drawing Sheets

HYDRAULIC MACHINE WITH OIL DAMS

TECHNICAL FIELD

The present invention relates to a hydraulic machine. More particularly, the present invention relates to a hydraulic machine having a rotating group and at least one oil dam associated with the rotating group.

BACKGROUND OF THE INVENTION

Hydraulic machines having a rotating group are generally known. One such machine is disclosed in U.S. Pat. No. 4,991,492. The rotating group of the hydraulic machine includes a shaft and a cylinder barrel that is connected to the shaft with a joint (or tripod) assembly. Pistons attached to the shaft extend into cylinder bores located in the cylinder barrel. When the cylinder barrel is angled relative to the shaft, the pistons move reciprocally within the cylinder bores. The cylinder barrel is tiltable relative to the shaft so that the hydraulic machine is capable of operating as both a hydraulic pump and a hydraulic motor.

In known hydraulic machines, like the one described above, the rotating group is submerged in hydraulic fluid for lubrication and cooling of the rotating group. Typically, the rotating group rotates at high speeds, at times up to 5,000 revolutions per minute. The rotation of the rotating group in the hydraulic fluid results in losses due to, amongst other things, flow resistance of the hydraulic fluid.

In order to reduce these losses, it is desirable to provide a hydraulic machine in which the rotating group is not submerged in hydraulic fluid. To accomplish this, some lubrication should be provided to locations of relative movement of the joint assembly with the shaft and cylinder barrel. The high speed of rotation of the rotating group makes such lubrication difficult as centrifugal force tends to force any lubricating fluid to the exterior of the rotating group.

SUMMARY OF THE INVENTION

At least one embodiment of the invention provides a hydraulic machine that includes a support structure and a rotating group rotatably mounted relative to the support structure. The rotating group includes a shaft and a cylinder barrel with a plurality of circumferentially spaced cylinder bores. Reciprocal pistons extend from the shaft with each one of the pistons extending into an associated one of the cylinder bores. A joining assembly joins the shaft and the cylinder barrel so that the shaft and the cylinder barrel rotate together. The hydraulic machine further includes at least one oil dam associated with the rotating group and adapted to trap hydraulic fluid used for lubricating portions of the joining assembly.

According to one embodiment, the hydraulic machine further includes a lubrication assembly for providing lubrication from a pressure passage within the hydraulic machine to a cavity at least partially closed by the oil dam. The hydraulic machine may have an oil dam that is associated with the shaft, may have an oil dam that is associated with the cylinder barrel, or may have both shaft and cylinder barrel oil dams.

According to an embodiment, the lubrication assembly may include a valve assembly having a shuttle portion that is movable within a stepped valve bore in response to a pressure differential between first and second pressure passages for opening fluid flow to a lowest pressure one of the first and second pressure passages.

BRIEF DESCRIPTION OF THE DRAWINGS

Embodiments of this invention will now be described in further detail with reference to the accompanying drawings, in which.

DETAILED DESCRIPTION OF THE INVENTION

Figure 1:
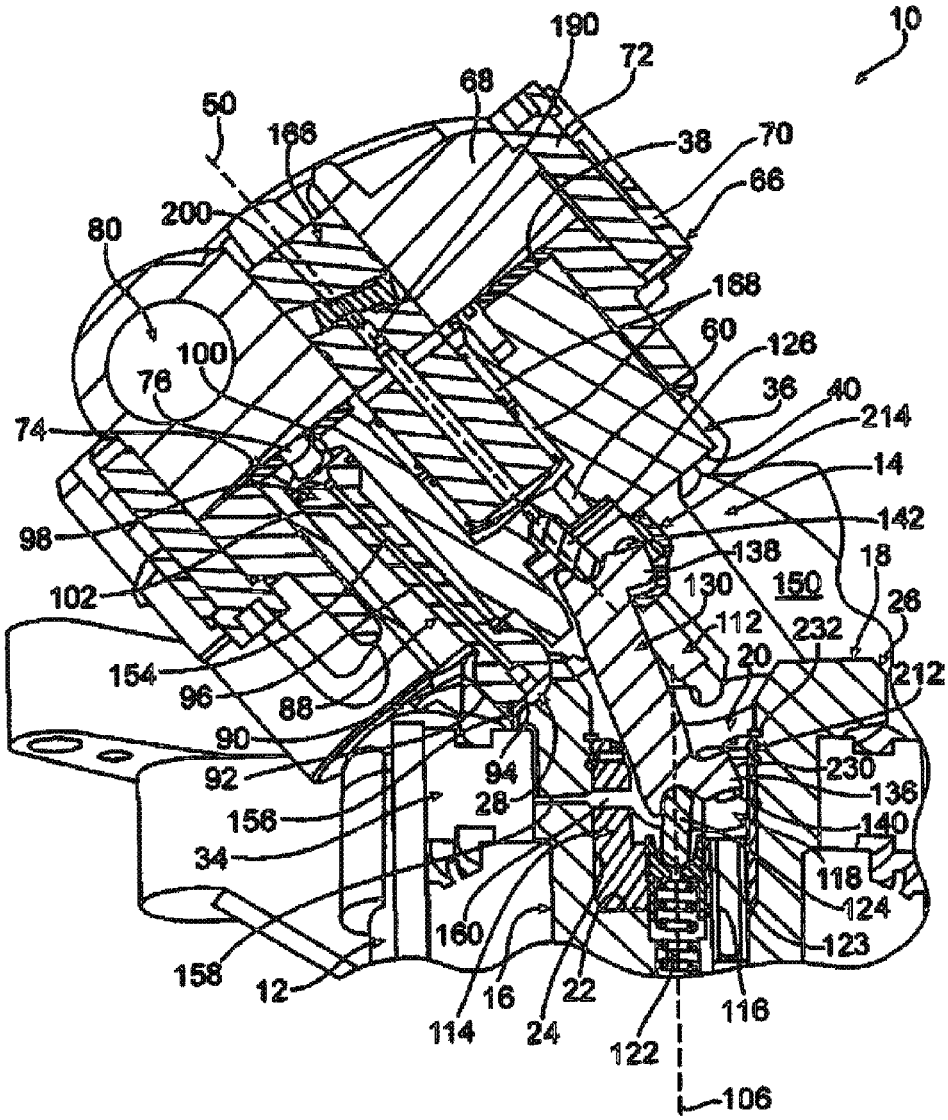
FIG. 1 is a cross-sectional view of a hydraulic machine constructed in accordance with an embodiment of the present invention with its associated oil dams.

FIG. 1 is a cross-sectional view of a hydraulic machine 10 constructed in accordance with an embodiment of the present invention. As will be discussed in greater detail below, in one embodiment of the present invention, the hydraulic machine 10 of FIG. 1 is capable of operating as both a hydraulic pump and a hydraulic motor. Alternatively, the hydraulic machine 10 may operate as only one of a hydraulic pump or a hydraulic motor.

The hydraulic machine 10 includes a support structure 12. In one example, the support structure 12 may be a housing. The support structure 12 rotatably supports a rotating group 14 of the hydraulic machine 10. The rotating group 14 includes a shaft 16, a portion of which is shown in FIG. 1. The shaft 16 includes an end 18 into which a hole 20 extends. The hole 20 terminates at an end wall 22 and has an outer periphery defined by cylindrical surface 24. The end 18 of the shaft 16 also includes a radially outwardly extending flange portion that defines a drive disk 26 of the shaft 16. A plurality of semi-spherical holes extends into the drive disk 26. FIG. 1 illustrates one of the semi-spherical holes at 28. The semi-spherical holes are spaced equally about the circumference of the drive disk 26. Bearing 34 extends between the support structure 12 and an exterior surface of the shaft 16 adjacent the drive disk 26 for supporting rotation of the shaft relative to the support structure.

Figure 2:
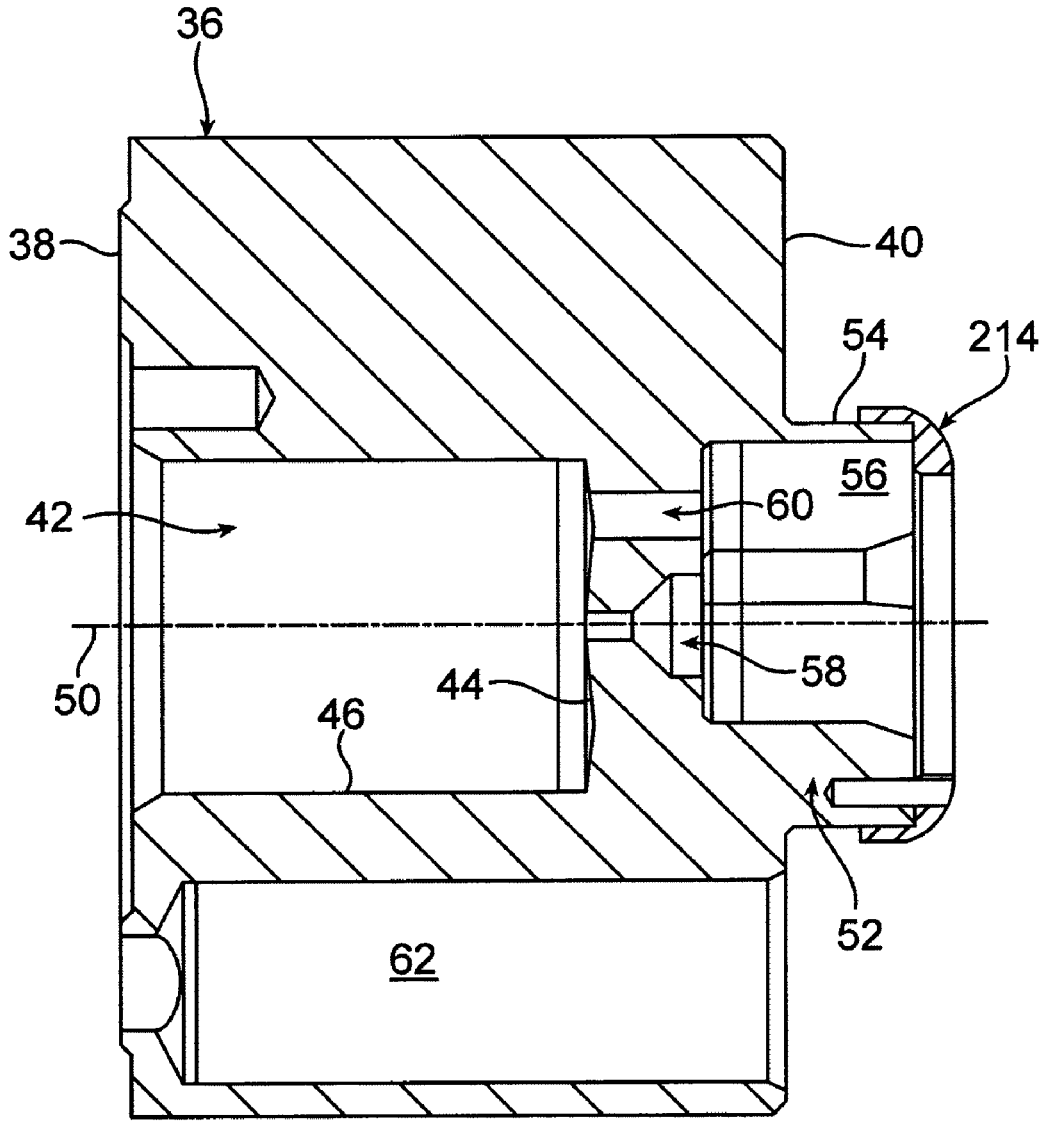
FIG. 2 is a cross-sectional view of a cylinder barrel and associated oil dam of the hydraulic machine of FIG. 1.
Figure 9:
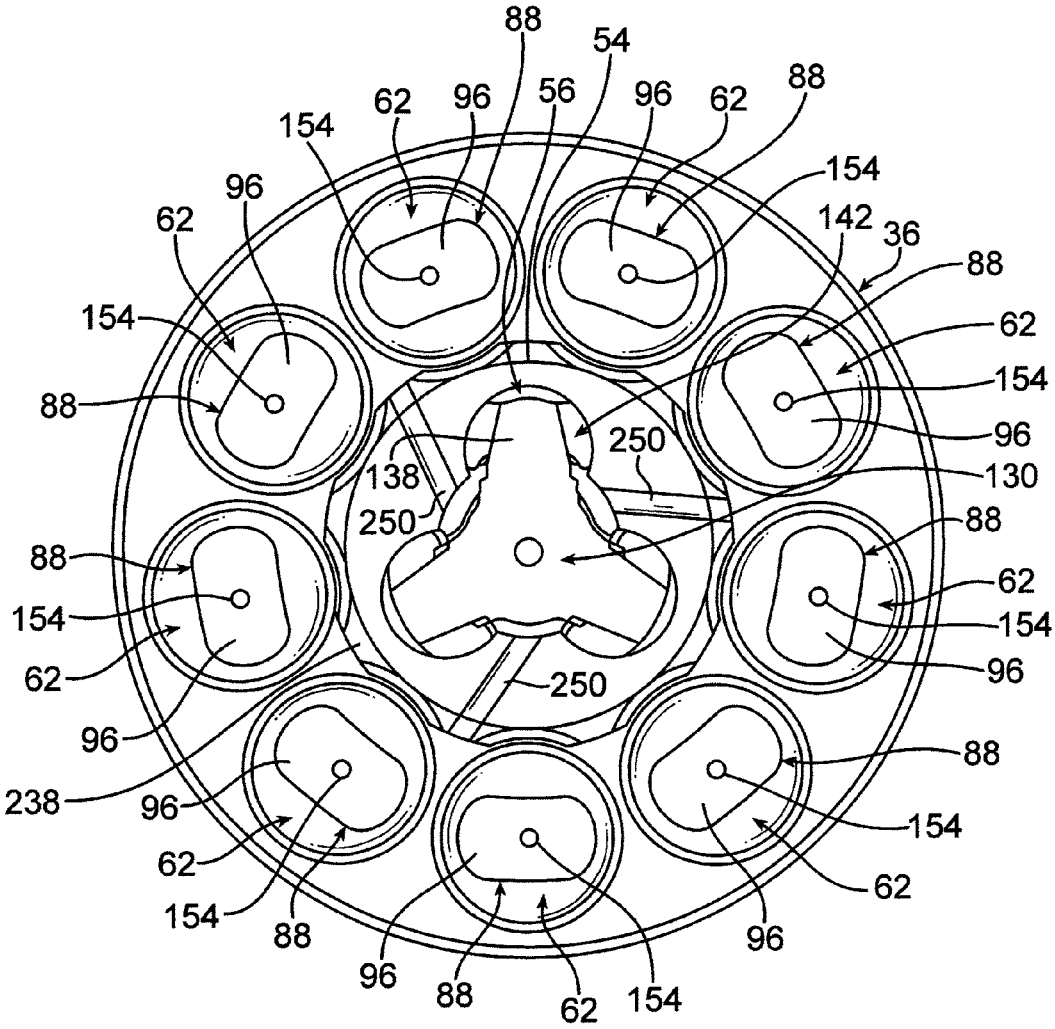
FIG. 9 is a partial sectional view illustrating yet another embodiment of an oil dam attached to a cylinder barrel.

The rotating group 14 also includes a cylinder barrel 36. A cross-section of the cylinder barrel 36 is illustrated in FIG. 2. The cylinder barrel 36 includes opposite first and second ends 38 and 40, respectively. A blind hole 42 extends into a first end 38 of the cylinder barrel 36. The blind hole 42 terminates at an end wall 44 and has an outer periphery defined by cylindrical surface 46 that is centered on a centerline 50 of the cylinder barrel 36. A boss 52 extends outwardly of the second end 40 of the cylinder barrel 36. The boss 52 has a cylindrical outer surface 54 and defines an internal lobed cavity 56 that extends into the cylinder barrel 36 beyond the second end 40. FIG. 9 illustrates an end view of the lobed cavity 56. The boss 52 includes both thick wall portions and thin wall portions for defining the lobed cavity 56. Two through-holes connect the blind hole 42 and the lobed cavity 56. A stepped through-hole 58 is located near the centerline 50 of the cylinder barrel 36 and another through-hole 60 is spaced radially away from the centerline 50. The cylinder barrel 36 also includes a plurality of circumferentially spaced cylinder bores 62, one of which is shown in FIG. 2.

Figure 7:
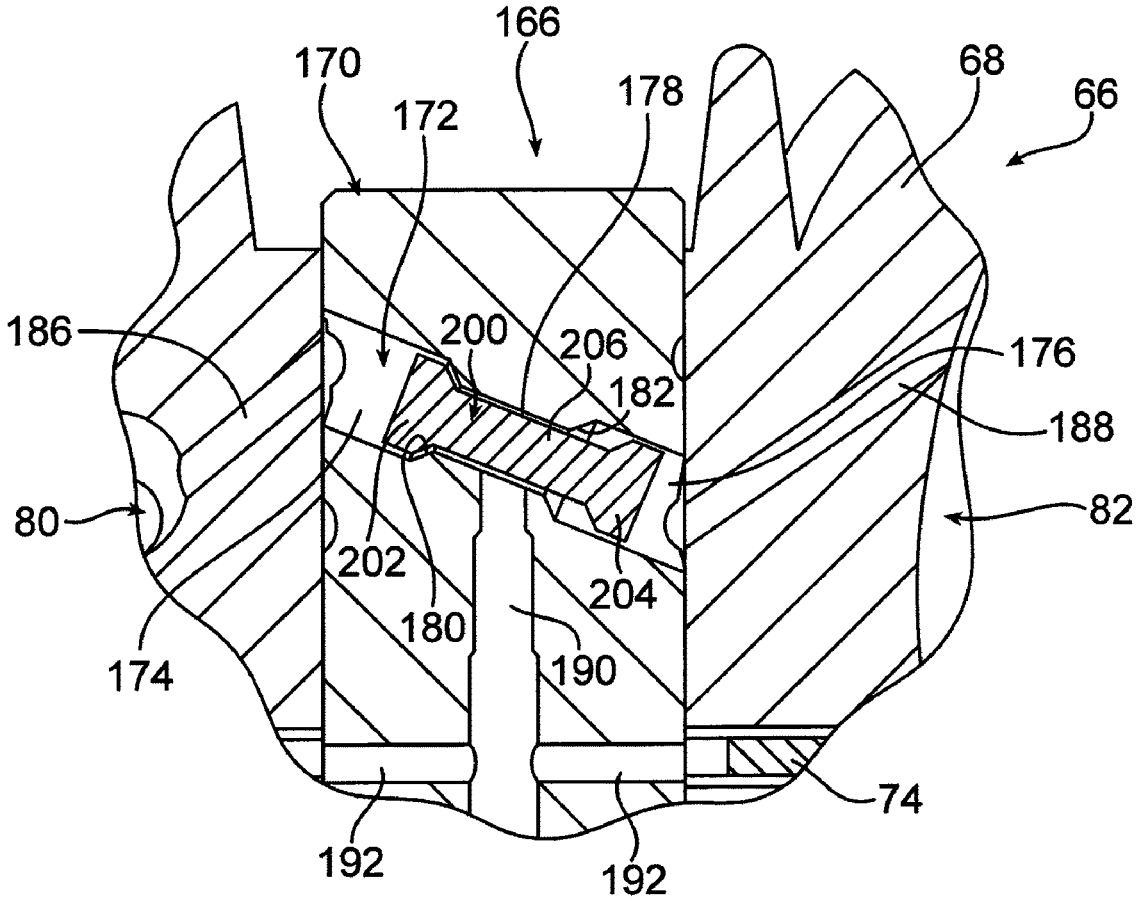
FIG. 7 is an enlarged view of a valve assembly located in a yoke of the hydraulic machine of FIG. 1.

The cylinder barrel 36 is supported in a yoke 66 of the hydraulic machine 10. The yoke 66 illustrated in FIG. 1 is a two-piece yoke having an upper yoke piece 68 and a lower yoke piece 70 fastened together by fasteners 72. The yoke 66 supports an annular plate 74 having ports, one of which is shown at 76 in FIG. 1. The cylinder barrel 36 rotates upon the plate 74 such that the cylinder bores 62 of the cylinder barrel 36 rotate into and out of fluid communication with the ports. The yoke 66 includes first and second pressure passages 80 and 82, respectively, through which hydraulic fluid passes when flowing to and from the ports of the plate 74. FIG. 7 illustrates portions of each of the pressure passages 80 and 82 of the yoke. 66 During operation of the hydraulic machine 10, one of the pressure passages 80 or 82 is a high pressure passage and the other of the pressure passages 82 or 80 is a low pressure passage. The yoke 66 is tiltable relative to the support structure 12 for tilting the cylinder barrel 36 relative to the shaft 16. Any known means for tilting the yoke 66 relative to the support structure 12 may be used with the hydraulic machine 10 of the present invention, including but not limited to one or more setting pistons, linear motors, or rotary motors.

The rotating group 14 also includes a plurality of pistons, one of which is illustrated at 88 in FIG. 1. Each piston 88 includes base 90 defined by a toroidal outer surface 92 and a flat bottom surface 94. A stem 96 extends outwardly from the base in a direction opposite the bottom surface 94. The stem 96 is tapered so that it widens as it extends away from the base 90. Each piston 88 terminates at a head portion 98 having a flat upper surface 100 and an annular outer surface 102 adapted to support a piston ring.

The number of pistons 88 equals the number of cylinder bores 62 in the cylinder barrel 36. In one embodiment, the hydraulic machine 10 includes nine pistons 88. Each one of the pistons 88 extends into an associated one of the cylinder bores 62 of the cylinder barrel 36. The base 90 of each piston 88 is received in and is movable within an associated one of the semi-spherical holes 28 in the end surface of the drive disk 26. When the cylinder barrel 36 is angled relative to a centerline 106 of the shaft 16, the pistons 88 reciprocate within their associated cylinder bores 62 during rotation of the rotating group 14. The greater the angle of the cylinder barrel 36 relative to the shaft 12, the greater the displacement resulting from the reciprocation of the piston 88 within the cylinder bore 62.

Figure 8:
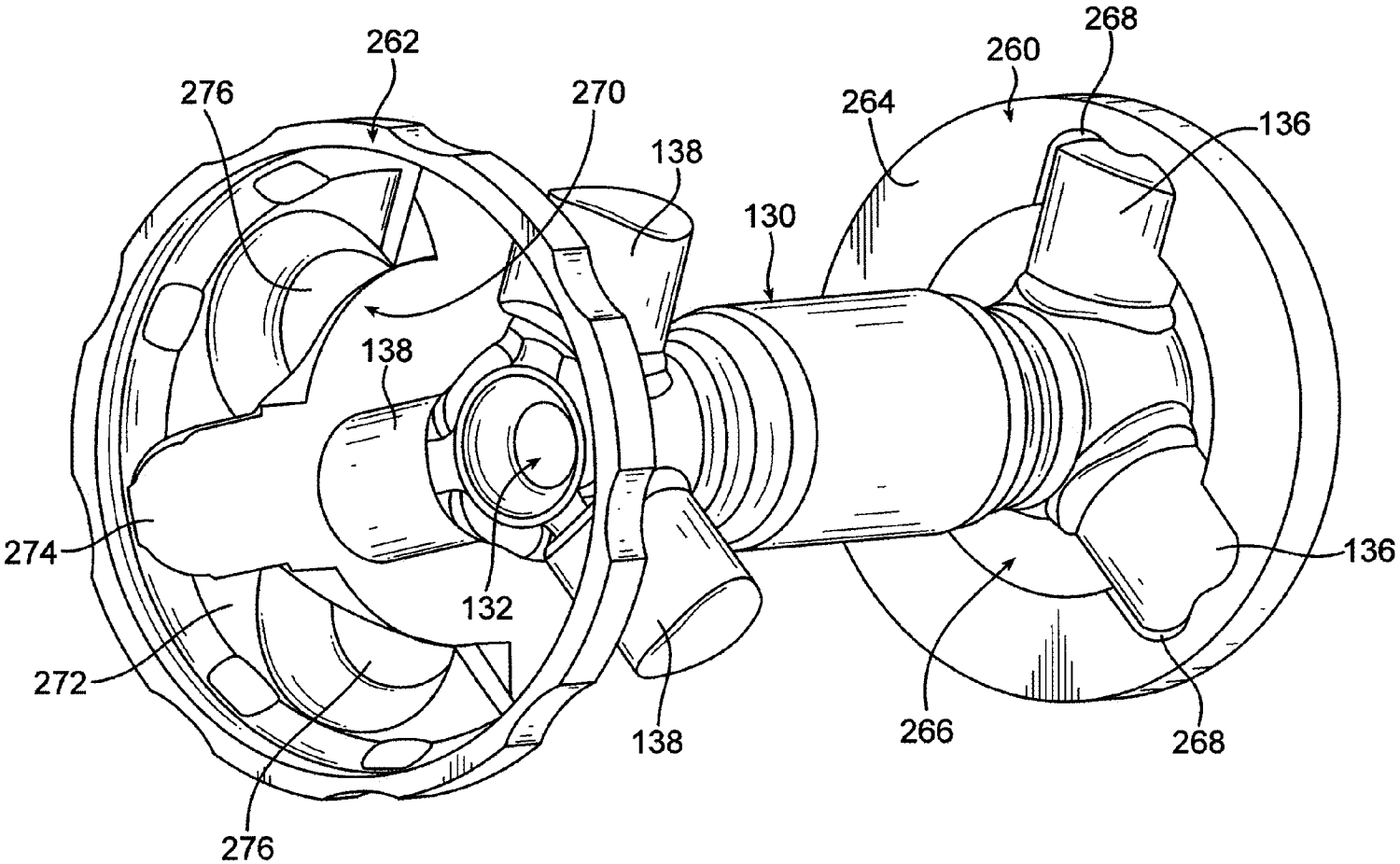
FIG. 8 is a perspective, partially exploded view illustrating a joint shaft and alternative embodiments of the cylinder barrel and shaft oil dams.

A joining assembly 112 is interposed between and mechanically connects the shaft 16 and the cylinder barrel 36. The joining assembly 112 includes a joint coupling 114 that is received in the hole 20 of the shaft 16 and is fixed for rotation with the shaft. FIG. 1 illustrates a fastener 116 fixing the joint coupling 114 relative to the shaft 16. Those skilled in the art will recognize that in addition to, or as an alternative to, the fastener 116, other means for fixing the joint coupling 114 to the shaft 16 may be used. The joint coupling 114 includes an internal lobed cavity 118. In one embodiment, the lobed cavity 118 has three circumferentially spaced lobes and is similar to the lobed cavity 56 illustrated in FIG. 9. A central through-hole extends through the joint coupling and connects to the lobed cavity 118. A compression spring 122 and a spring guide 123 are received in the central through-hole and support a portion of a support pin 124. The support pin 124 supports an end of a joint shaft 130 relative to the shaft 16. Another support pin 126, located in the stepped through-hole 58 of the cylinder barrel 36, supports an opposite end of the joint shaft 130 relative to the cylinder barrel 36. Spherical grooves 132 (FIG. 8) extend into each end of the joint shaft 130 for receiving an end of the associated support pin 124 or 126. Three, spaced apart legs extend radially outwardly of the joint shaft 130 at each end. FIG. 8 illustrates a perspective view of the joint shaft 130 with the legs located at the shaft end being indicated by 136 and, the legs located at the cylinder barrel end being indicated by 138. The joint shaft 130 is elongated between its ends. Each of the legs 136 and 138 of the joint shaft 130 receives an associated roller for enabling a tilting of the joint shaft relative to the shaft 16 and the cylinder barrel 36. FIG. 1 illustrates roller 140 received on leg 136 and, roller 142 received on leg 138.

The rotating group 14 of the hydraulic machine 10 is not submerged in hydraulic fluid. Thus, the area 150 of the hydraulic machine 10 located between the shaft 16 and the cylinder barrel 36 is generally free of hydraulic fluid. The hydraulic machine 10 includes a lubrication assembly for providing lubrication to the rollers 140 and 142 located on the joint shaft 130 of the joining assembly 112 during operation of the hydraulic machine 10. The lubrication assembly includes a shaft lubrication portion for providing lubrication to the rollers 140 located on legs 136 of the joint shaft 130 and positioned within the shaft 16 and a barrel lubrication portion for providing lubrication to the rollers 142 located on legs 138 of the joint shaft 130 and positioned within the cylinder block 36.

The shaft lubrication portion includes a plurality of fluid paths for providing fluid to the lobed cavity 118 of the joint coupling 114. One of the paths is illustrated in FIG. 1. The other paths are constructed in a similar manner. The path illustrated in FIG. 1 includes a through-hole 154 that extends longitudinally through the piston 88. As shown in FIG. 1, the through-hole 154 extends between the flat upper surface 100 of the head portion 98 of the piston 88 and the flat bottom surface 94 of the base 90 of the piston. Hydraulic fluid entering the cylinder bore 62 from port 76 flows through the through-hole 154 in the piston 88 to a pool located beneath the base 90 of the piston 88 in the semi-spherical hole 28 of the drive disk 26. A flow path portion 156 extends from the pool of the semi-spherical hole 28 in the drive disk 26 and through the drive disk in a direction parallel to the centerline 106. The flow path portion 156 then extends along the outer surface of the shaft 16. The flow path portion 156 may include, in part, a groove machined into the outer surface of the shaft 16 and closed by the close contact of the bearing 34. The flow path portion 156 connects with radially extending flow path portions 158 and 160. Flow path portion 158 extends radially through the shaft 16 and, flow path portion 160 extends radially through the joint coupling 114 to the lobed cavity 118.

The barrel lubrication portion of the lubrication assembly includes a valve assembly 166 that is fixed within a through-hole of the yoke 66 and extends into the blind hole 42 on the first end 38 of the cylinder barrel 36. Bearings 168, such as needle bearings, are interposed between the valve assembly 166 and the cylinder barrel 36 for enabling rotation of the cylinder barrel about the valve assembly. The valve assembly 166 includes a cylindrical body portion 170 (FIG. 7) having a stepped valve bore 172 that is angled relative to centerline 50 passing through the cylindrical body portion, as shown in FIG. 1. As best shown in FIG. 7, first and second ends 174 and 176, respectively, of the valve bore 172 are larger in diameter than a central portion 178 of the valve bore. Shoulder 180 defines the transition between the first end 174 of the valve bore 172 and the central portion 178 of the valve bore and, shoulder 182 defines the transition between the second end 174 and the central portion 178 of the bore. As shown in FIG. 7, the first end 174 of the valve bore 172 is in communication with the first pressure passage 80 of the yoke 66 via a first cross-port 186 and, the second end 176 of the valve bore 172 is in fluid communication with the second pressure passage 82 of the yoke 66 via a second cross-port 188. A main lubrication passage 190 extends downwardly, as viewed in FIG. 7, from the central portion 178 of the valve bore 172 along the centerline 50 and terminates at a lower end wall of the cylindrical body portion 170 of the valve assembly 166. Radial passages 192 extend outwardly from the main lubrication passage 190 to an outer wall of the cylindrical body portion 170 at a location near the plate 74. Flow through the radial passages 192 provides lubrication to the bearings 168.

A shuttle portion 200 of the valve assembly 166 is located in the valve bore 172. The shuttle portion 200 controls the flow of lubricating fluid from the first and second pressure passages 80 and 82 of the yoke 66 to the main lubrication passage 190 of the valve assembly 166. The shuttle portion 200 is generally bone-shaped having larger diameter first and second end sections 202 and 204 that are connected by a narrow central section 206. The central section 206 of the shuttle portion 200 is longer than the central portion 178 of the valve bore 172 such that when one of the first and second end sections 202 or 204 abuts its associated shoulder 180 or 182, the other of the first and second end sections 204 or 202 is spaced away from the other shoulder 182 or 180. For example, with reference to FIG. 7, when the first end section 202 of the shuttle portion 200 abuts shoulder 180, the second end section 204 is spaced away from shoulder 182. In this illustrated condition, fluid may flow from the second pressure passage 82 into the second end 176 of the valve bore 172, about the second end section 204 of the shuttle portion 200 and into the main lubrication passage 190 of the valve assembly 166. The shuttle portion 200 is adapted to move based upon a differential pressure between the first and second pressure passages 80 and 82 of the yoke 66 and thus, the differential pressure between the first and second ends 174 and 176 of the valve bore 172. High pressure fluid acts upon the associated end section of the shuttle portion 200 to force the end section into engagement with its associated shoulder for opening fluid communication between the low pressure passage of the yoke 66 and the main lubrication passage 190 of the valve assembly 166.

Fluid passing through the main lubrication passage 190 of the valve assembly 166 collects in a small chamber located in the blind hole 42 of the cylinder barrel 36 between the lower end wall of the cylindrical body portion 170 of the valve assembly and the end wall 44 of the cylinder barrel. Fluid passing through the radial passages 192 for lubricating the bearings 168 also collects in the chamber. The fluid in the chamber is in fluid communication with the lobed cavity 56 of the boss 52 of the cylinder barrel 36 via the stepped through-hole 58 and through-hole 60.

Figure 5:
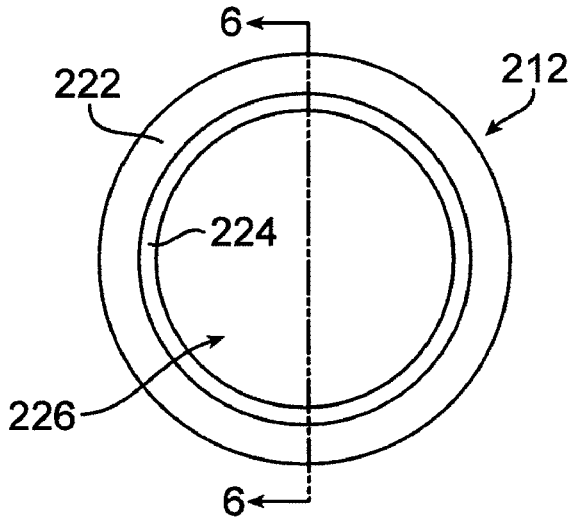
FIG. 5 is a top view of an oil dam associated with a shaft of the hydraulic machine of FIG. 1.
Figure 6:
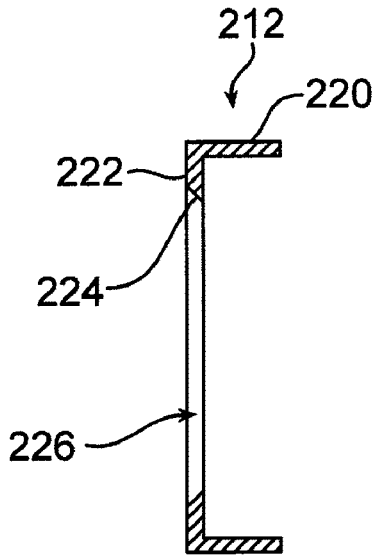
FIG. 6 is a cross-sectional view taken along line 6-6 in FIG. 5.

The hydraulic machine 10 illustrated in FIG. 1 also includes oil dams 212 and 214, respectively, associated with the shaft 16 and the cylinder barrel 36 for at least partially closing the lobed cavities 118 and 56 for trapping fluid to lubricate movement of the joining assembly 112 relative to the shaft 16 and cylinder barrel 36, respectively. FIG. 5 illustrates a top view of the shaft oil dam 212 and, FIG. 6 illustrates a cross-sectional view of the shaft oil dam 212. The shaft oil dam 212 is annular and includes a cylindrical sidewall 220 that extends downwardly from flat top wall 222. The top wall 222 is adapted to cover a peripheral portion of the opening to the lobed cavity 118 and includes a tapered edge 224 that defines a central opening 226. The outer diameter of the sidewall 220 of the shaft oil dam 212 is approximately equal to the diameter of the cylindrical surface 24 defining hole 20 of the shaft 16 so that the shaft oil dam 212 fits tightly into the hole 20. When assembled into the hole 20 illustrated in FIG. 1, the shaft oil dam 212 is located atop the joint coupling 114 and is interposed between an o-ring 230 and a retaining ring 232. The retaining ring 232 snaps into a groove located in the cylindrical surface 24 and is adapted to engage the top wall 222 of the shaft oil dam 212 to secure the shaft oil dam in the hole 20 of the shaft 16 and fix the shaft oil dam 212 for rotation with the shaft. As an alternative to a retaining ring 232, other means for securing the shaft oil dam 212 in the hole 20 and fixing the shaft oil dam 212 for rotation with the shaft 16 may be used. Other example means for securing the shaft oil dam 212 relative to the shaft 16 include press fitting the shaft oil dam 212 into the hole 20, using an adhesive, one or more fasteners or a combination of an adhesive and fasteners to hold the shaft oil dam 212 relative to the shaft 16, or providing a threaded interconnection between the shaft oil dam 212 and the cylindrical surface 24 of the shaft 16 or a surface of the joint coupling 114. As yet another alternative, the shaft oil dam 212 may be formed integrally with the shaft 16 or the joint coupling 114 as long as provisions are provided for enabling insertion of the joint shaft 130 with associated rollers 140. Such provisions may include a large central opening or cutouts, such as will be described with reference to FIG. 8.

Figure 3:
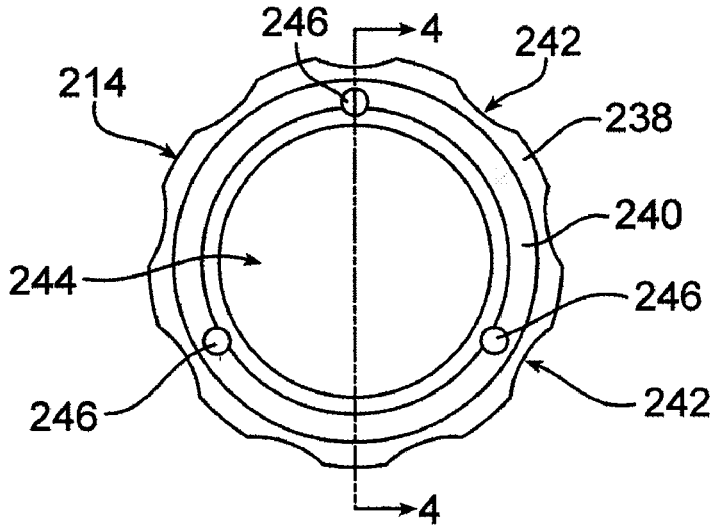
FIG. 3 is a bottom view of the cylinder barrel oil dam for the hydraulic machine of FIG. 1.
Figure 4:
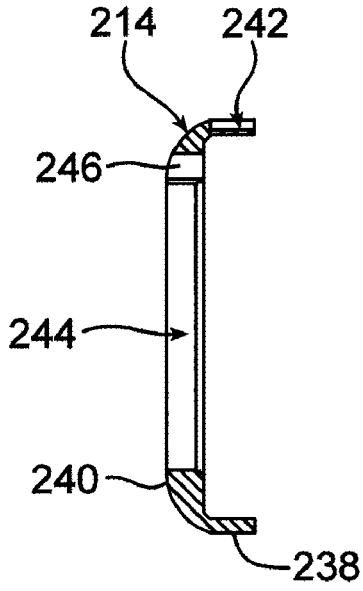
FIG. 4 is a cross-sectional view taken along line 4-4 in FIG. 3.

FIG. 3 illustrates a bottom view of the cylinder barrel oil dam 214 and, FIG. 4 illustrates a cross-sectional view of the cylinder barrel oil dam 214. The cylinder barrel oil dam 214 is annular and includes a generally cylindrical sidewall 238 that extends downwardly from an annular and generally flat top wall 240. A number of arched cutouts 242 extend into the sidewall 238 at spaced intervals about its circumference. The number of cutouts 242 equals the number of cylinder bores 62 in the cylinder barrel 36. The internal diameter of the sidewall 238 is sized to receive the boss 52 on the second end 40 of the cylinder barrel 36. The length of the sidewall 238 may be varied for completely covering the cylindrical outer surface 54 of the boss 52. The top wall 240 defines a central opening 244 through which the joint shaft 230 extends. In the embodiment illustrated in FIG. 3, three holes 246 for receiving spring pins extend through the top wall 240. FIG. 4 illustrates a cross-section of one of the holes 246 and, FIG. 1 illustrates a spring pin extending through one of the holes for fixing the cylinder barrel oil dam 214 to the boss 52. In an alternative embodiment illustrated in FIG. 9, three holes 250 for receiving spring pins extend through the sidewall 238 of the cylinder barrel oil dam 214. Other structures in FIG. 9 have the same reference numbers as used previously. In addition to, or as an alternative to, the use of spring pins for securing the cylinder barrel oil dam to the boss for rotation with the cylinder barrel, adhesives or other fasteners or a combination of both may be used. As a further alternative, the cylinder barrel oil dam may be press fit on or snap fit on the boss. As yet another alternative, the cylinder barrel oil dam 214 may be formed integrally with the cylinder barrel 36 or the boss 52 of the cylinder barrel as long as provisions are provided for enabling insertion of the joint shaft 130 with associated rollers 142. Such provisions may include a large central opening or cutouts, such as will be described with reference to FIG. 8.

The oil dams 212 and 214 function to trap lubricating fluid for lubricating the rollers 140 and 142 of the joining assembly 112. Fluid provided to the shaft lubrication portion of the lubrication assembly is trapped in the lobed cavity 118 of the joint coupling 114 by shaft oil dam 212. Similarly, fluid provided to the barrel lubrication portion of the lubrication assembly is trapped in the lobed cavity 56 of the boss 52 by cylinder barrel oil dam 214. The top walls 222 and 240 of the oil dams 212 and 214, respectively, overhang peripheral portions of the openings to the lobed cavities 118 and 56, respectively. Due to the high rate of rotation of the rotating group 14, the fluid located in the lobed cavities 56 and 118 is forced outwardly by centrifugal force. The overhanging portions of the oil dams 212 and 214 trap the fluid in the lobed cavities 118 and 56 for lubricating the rollers 140 and 142 during operation of the hydraulic machine 10.

FIG. 8 is a perspective, partially exploded view illustrating a joint shaft 130 and alternative embodiments of the shaft and cylinder barrel oil dams 260 and 262, respectively. In FIG. 8, structures that are similar to those described previously are labeled with the same reference numbers as previously used. In FIG. 8, the top wall 264 of the shaft oil dam 260 extends inwardly a greater distance than the top wall 224 described with reference to FIGS. 5 and 6. As a result, the opening 266 in the top wall 264 is too small for receiving the legs 136 of the joint shaft 130. To enable the oil dam 260 to receive the legs 136, three cutouts 268 (two of which are shown) are formed in the top wall 264 for receiving the legs 136. The cutouts 268 may be sized for receiving the legs 136 only, when the rollers 140 are assembled onto the legs 136 after insertion of the joint shaft 130 through the shaft oil dam 260, or may be sized for receiving both the legs 136 and the rollers 140. Similarly, the opening 270 in the top wall 272 of the cylinder barrel oil dam 262 is too small to receive the legs 138 of joint shaft 130. Thus, the cylinder barrel oil dam 262 also includes three cutouts, 274 (one of which is completely shown) sized for receiving legs 138. The cutouts 274 may be sized for receiving the legs 138 only, when the rollers 142 are assembled onto the legs 138 after insertion of the joint shaft 130 through the cylinder barrel oil dam 262, or may be sized for receiving both the legs 138 and the rollers 142. When assembled into a hydraulic machine 10, the cutouts 268 and 274 are positioned over thick walled portions between lobes of the respective lobed cavities 118 and 56 and the legs 136 and 138 are received in indented portions, like those indicated at 276 in FIG. 8, of the oil dams 260 and 262.

According to one method of assembling the hydraulic machine 10, spring pins for attaching the cylinder barrel oil dam 214 to the boss 52 are inserted into holes in the boss. The joint shaft 130 is inserted through the central opening 244 of the cylinder barrel oil dam 214 and, rollers 142 are assembled onto the legs 138 of the joint shaft. Grease is placed in the stepped through-hole 58 for temporarily supporting the support pin 126 and, the support pin 126 is positioned in the grease. The joint shaft 130 then is inserted into the lobed cavity 56 of the boss 52 such that the end of the joint shaft 130 is supported by the support pin 126. Adhesive is applied to internal surfaces of the oil dam 214 and, the oil dam 214 is secured to the cylinder barrel 36 by pressing the oil dam toward the boss 52 such that the spring pins are received in the holes 246 of the oil dam.

Next, the joint coupling 114 is inserted into the hole 20 of the shaft 16 and is fixed relative to the shaft. The spring 122 and the spring guide 123 are positioned relative to the joint coupling 114 and, the support pin 124 is placed in the spring guide 123. The o-ring 230 is assembled atop the joint coupling 114. Next, the pistons 88 are attached to the shaft 16 by inserting each piston into its associated semi-spherical hole 28. The joint shaft 130 then is inserted through the central openings of the retaining ring 232 and the shaft oil dam 212. Next, the rollers 140 are assembled onto the legs 136 of the joint shaft 130 and, the joint shaft 130 is inserted into the lobed cavity 118 of the joint coupling 114 such that it is supported by the support pin 124. The shaft oil dam 212 is positioned atop the o-ring 230 and the joint coupling 114 and fixed in place by the retaining ring 232. Lastly, the rotating group 14 is assembled relative to the support structure 12 and yoke 66.

Figure 10:
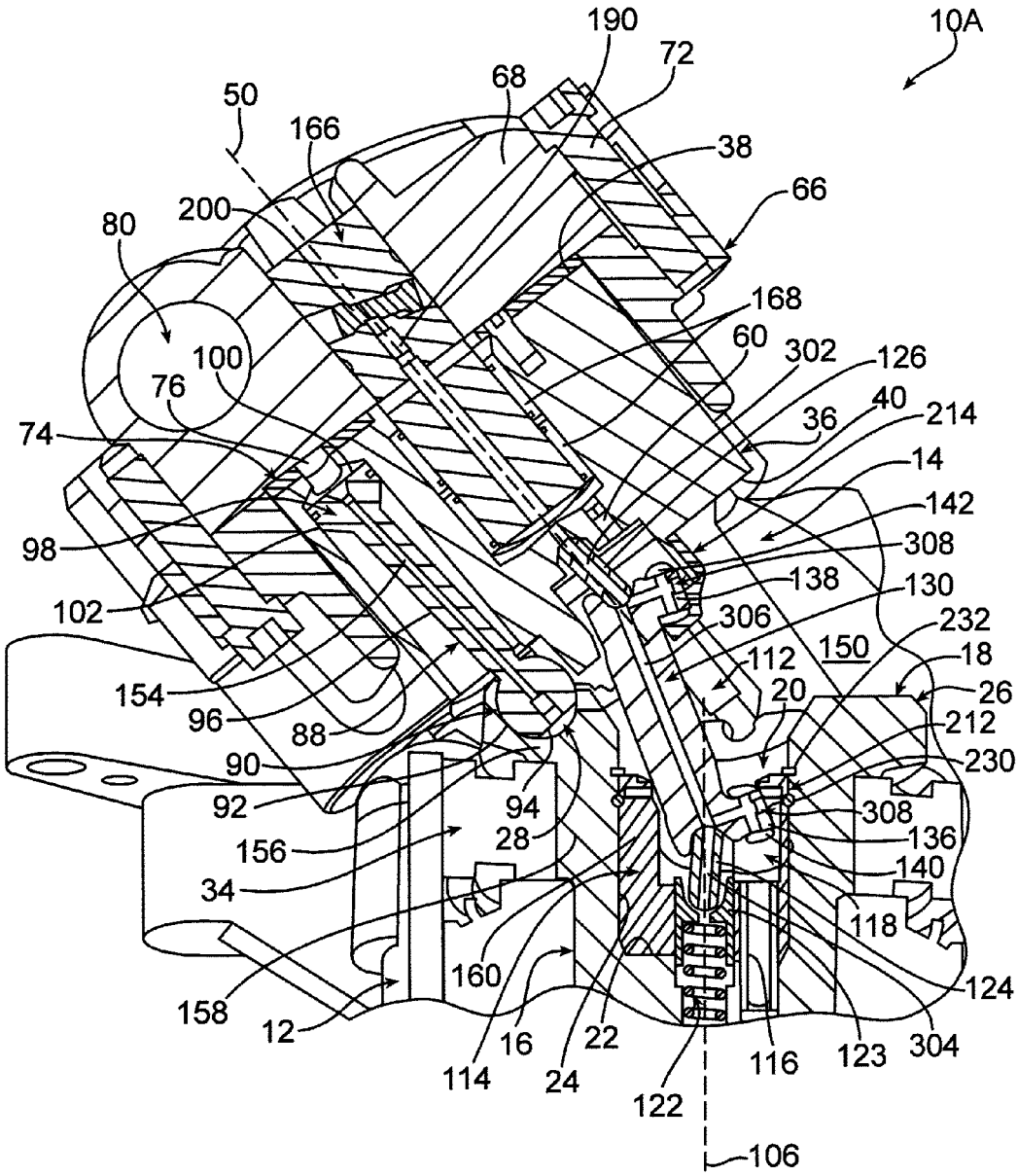
FIG. 10 is a cross-sectional view of a hydraulic machine constructed in accordance with an alternate embodiment of the present invention with its associated oil dams.

FIG. 10 is a cross-sectional view of a hydraulic machine 10A constructed in accordance with an alternative embodiment of the present invention. Components in FIG. 10 that are the same as or similar to those shown in FIG. 1 are identified by the same reference number as used in FIG. 1. In the hydraulic machine 10A of FIG. 10, the shaft lubrication portion of the lubrication assembly differs from that illustrated in FIG. 1. In the hydraulic machine 10A of FIG. 10, the through-holes 154 that extend longitudinally through the pistons 88 merely provide lubrication to the semi-spherical hole 28 of the drive disk 26 for lubricating movement of the piston. The shaft lubrication portion is located downstream of the valve assembly 166 and is provided fluid from the barrel lubrication portion. The shaft lubrication portion includes flow paths that extend through the support pins 124 and 126 and through the joint shaft 130 for providing lubrication to the internal lobed cavity 118. In FIG. 10, a longitudinal flow path 302 extends through support pin 124. Support pin 126 also includes a longitudinal flow path 304. Joint shaft 130 includes a longitudinal flow path 306 that extends between opposite ends and a plurality of flow paths, generally indicated by 308, for providing fluid to the surfaces of the legs 136 and 138 near the respective rollers 140 and 142. Radially paths that form a portion of the flow paths 308 are closed by a plug to force lubricating fluid to the rollers 140 and 142. Also, through-hole 60 in the cylinder barrel 36 is closed by an orifice plug to force lubricating fluid to pass through the stepped through-hole 58 and into the longitudinal flow path 302 of support pin 124.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

What is claimed is:

1. A hydraulic machine comprising:

a support structure;

a rotating group rotatably mounted relative to the support structure and including a shaft and a cylinder barrel with a plurality of circumferentially spaced cylinder bores, reciprocal pistons extending from the shaft with each one of the pistons extending into an associated one of the cylinder bores, a joining assembly including a joining member joining the shaft and the cylinder barrel so that the shaft and the cylinder barrel rotate together; and at least one cylinder barrel oil dam positioned about an end of the joining member closest to the cylinder barrel of the rotating group and adapted to trap hydraulic fluid within a cavity extending into the cylinder barrel.

2. The hydraulic machine of claim 1 wherein a portion of the support structure houses the rotating group wherein the portion of the support structure is not filled with hydraulic fluid to a level wherein the rotating group would be submerged in hydraulic fluid.

3. The hydraulic machine of claim 1 further including a lubrication assembly comprising a plurality of flow paths adapted to provide fluid from a cylinder bore of the cylinder barrel to a cavity located in the shaft.

4. The hydraulic machine of claim 3, wherein the lubrication assembly includes a radially extending flow path portion extending through the shaft for providing fluid to the cavity in the shaft.

5. The hydraulic machine of claim 4 wherein the lubrication assembly further includes a through-hole that extends longitudinally through each piston and other flow path portions that extend between semi-spherical holes in the shaft for receiving the pistons and the radially extending flow path portion.

6. The hydraulic machine of claim 3, wherein the lubrication assembly includes a barrel lubrication portion for providing hydraulic fluid to the cylinder barrel cavity, the barrel lubrication portion including passages for providing fluid from the pressure passage to the cylinder barrel cavity that is at least partially closed by the cylinder barrel oil dam.

7. The hydraulic machine of claim 1, further including a shaft oil dam positioned about an end of the joining member closest to the shaft.

8. The hydraulic machine of claim 7 wherein the shaft oil dam is an annular member having a generally flat top wall adapted to cover a peripheral portion of an opening to the cavity of the shaft.

9. The hydraulic machine of claim 8 wherein the shaft oil dam is secured in the cavity in the shaft and is fixed for rotation with the shaft.

10. The hydraulic machine of claim 1 wherein the cylinder barrel oil dam is an annular member having a generally flat top wall adapted to cover a peripheral portion of an opening to the cylinder barrel cavity.

11. The hydraulic machine of claim 10 wherein a generally cylindrical sidewall extends downwardly from the top wall of the cylinder barrel oil dam, the generally cylindrical sidewall being sized to receive a boss of the cylinder barrel.

12. The hydraulic machine of claim 10 wherein the cylinder barrel oil dam is secured to the cylinder barrel and is fixed for rotation with the cylinder barrel.

13. A hydraulic machine comprising:

a support structure;

a rotating group rotatable mounted relative to the support structure and including a shaft and a cylinder barrel with a plurality of circumferentially spaced cylinder bores, reciprocal pistons extending from the shaft with each one of the pistons extending into an associated one of the cylinder bores, a joining assembly joining the shaft and the cylinder barrel so that the shaft and the cylinder barrel rotate together;

a shaft oil dam associated with the shaft for trapping fluid for providing lubrication for movement of a portion of the joining assembly relative to the shaft;

a cylinder barrel oil dam associated with the cylinder barrel for trapping fluid for providing lubrication for movement of a portion of the joining assembly relative to the cylinder barrel; and a lubrication assembly for providing lubrication from a pressure passage within the hydraulic machine to a cavity at least partially closed by the oil dam;

wherein the lubrication assembly includes a barrel lubrication portion for providing hydraulic fluid to the cylinder barrel cavity, the barrel lubrication portion including passages for providing fluid from the pressure passage to the cylinder barrel cavity that is at least partially closed by the cylinder barrel oil dam;

wherein the pressure passage is a first pressure passage, the hydraulic machine further including a second pressure passage, the barrel lubrication portion further includes a valve assembly located between the first and second pressure passages and adapted to control the flow of fluid to the cylinder barrel cavity.

14. The hydraulic machine of claim 13 wherein the valve assembly includes a shuttle portion that is movable within a stepped valve bore of the valve assembly in response to a pressure differential between the first and second pressure passages, the shuttle portion adapted to open fluid flow to a lowest pressure one of the first and second pressure passages.

15. A hydraulic machine comprising:

a support structure;

a rotating group rotatably mounted relative to the support structure and including a shaft and a cylinder barrel with a plurality of circumferentially spaced cylinder bores, reciprocal pistons extending from the shaft with each one of the pistons extending into an associated one of the cylinder bores, a joining assembly joining the shaft and the cylinder barrel so that the shaft and the cylinder barrel rotate together;

an oil dam associated with the rotating group and adapted to trap hydraulic fluid used for lubricating portions of the joining assembly, wherein the oil dam is a cylinder barrel oil dam associated with the cylinder barrel for trapping fluid for providing lubrication for movement of a portion of the joining assembly relative to the cylinder barrel; and a lubrication assembly for providing lubrication from a pressure passage within the hydraulic machine to a cavity at least partially closed by the oil dam;

wherein the lubrication assembly includes a barrel lubrication portion for providing hydraulic fluid to a location beneath the oil dam and wherein the pressure passage is a first pressure passage, the hydraulic machine further including a second pressure passage, the barrel lubrication portion further includes a valve assembly located between the first and second pressure passages and having a shuttle portion that is movable within a stepped valve bore of the valve assembly in response to a pressure differential between the first and second pressure passages, the shuttle portion adapted to open fluid flow to a lowest pressure one of the first and second pressure passages.

* * * * *